United States Patent [19]

Sato

[11] 4,251,107

[45] Feb. 17, 1981

[54] COLLAPSIBLE RECLINING CHAIR

[75] Inventor: Reiji Sato, Tokyo, Japan

[73] Assignee: Sugatsune Industrial Co., Ltd., Tokyo, Japan

[21] Appl. No.: 946,759

[22] Filed: Sep. 28, 1978

[30] Foreign Application Priority Data

| | | | |
|---|---|---|---|
| Mar. 20, 1978 | [JP] | Japan | 53/36043[U] |
| Mar. 20, 1978 | [JP] | Japan | 53/36045[U] |
| Mar. 29, 1978 | [JP] | Japan | 53/40555[U] |
| Mar. 29, 1978 | [JP] | Japan | 53/40556[U] |
| Mar. 29, 1978 | [JP] | Japan | 53/40557[U] |
| Mar. 29, 1978 | [JP] | Japan | 53/40558[U] |

[51] Int. Cl.[2] ..... A47C 4/00

[52] U.S. Cl. ..... 297/19; 297/29; 297/318

[58] Field of Search ..... 297/29, 19, 26, 318, 297/317

[56] References Cited

U.S. PATENT DOCUMENTS

| | | | |
|---|---|---|---|
| 101,628 | 4/1870 | Kilian | 297/26 |
| 438,570 | 10/1890 | Smith | 297/29 |
| 1,860,867 | 5/1932 | Matthews | 297/29 |
| 2,347,478 | 4/1944 | Heddens | 297/29 |
| 2,571,463 | 10/1951 | Lorenz | 297/29 |
| 4,045,081 | 8/1977 | Ueno | 297/355 |

FOREIGN PATENT DOCUMENTS

| | | | |
|---|---|---|---|
| 1395801 | 3/1965 | France | 297/26 |
| 591920 | 9/1947 | United Kingdom | 297/318 |

*Primary Examiner*—Francis K. Zugel

*Attorney, Agent, or Firm*—George B. Oujevolk

[57] ABSTRACT

A reclining chair having a collapsible construction in which a chair body composed of a back-rest and seat portion pivotally coupled to each other is rotatably pivoted onto a stool composed of frame members in such a manner that said back-rest can be adjusted to a desired angle of inclination with a longitudinal movement of said seat portion interlocked therewith when the reclining chair is extended for use, while said back-rest can be folded onto said seat portion and brought down together therewith to a position between said frame members in the folded position thereof when the reclining chair is not used, with intermediately folded positions being available, as desired, for a tentative storage thereof.

1 Claim, 18 Drawing Figures

FIG.6(B)
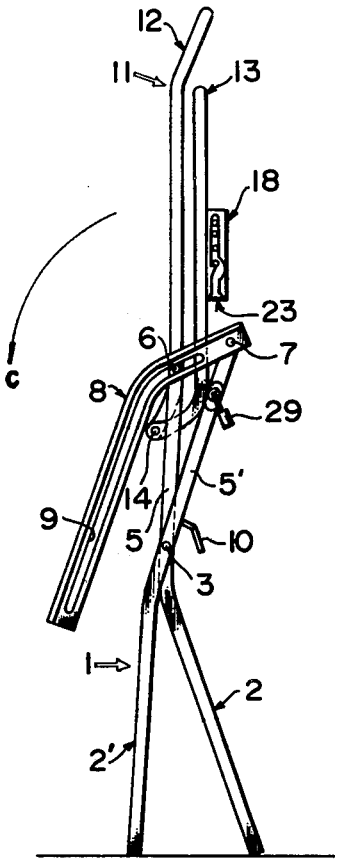
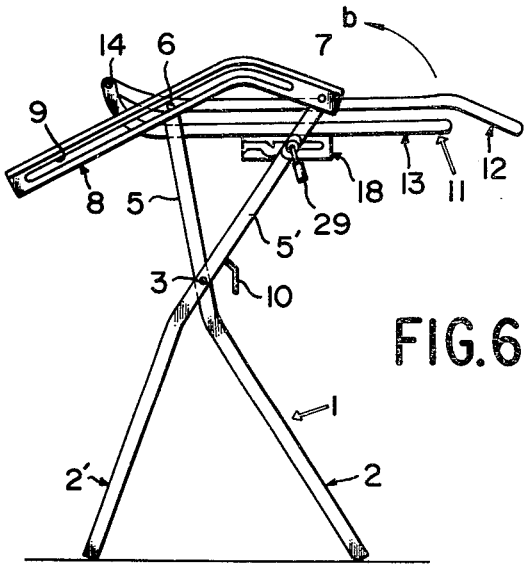
FIG.6(A)
FIG.6(C)
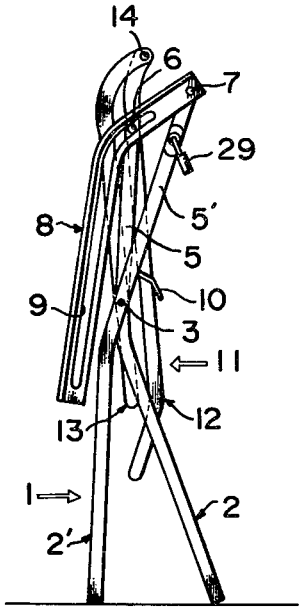

COLLAPSIBLE RECLINING CHAIR

BACKGROUND OF THE INVENTION

The present invention relates to a reclining chair of collapsible structure.

Reclining chairs have not been widely accepted because they occupy a relatively large space for storage and living space is taken up when they are not used.

Also, since great inconvenience is encountered in carrying, shipping or transporting incollapsible reclining chairs, it has been proposed so far to adapt these reclining chairs so that they can be disassembled. However, such disassembled reclining chairs have been awkward or troublesome to reassemble or to store when they are not used.

The inventors have conducted a series of intensive studies to overcome the foregoing shortcomings of the prior art reclining chairs and achieved the present invention.

OBJECTS OF THE INVENTION

Accordingly, an object of the present invention is to provide a collapsible reclining chair in which its chair body is pivotally coupled to its stool at certain positions and the chair body is engageably fitted freely and removably to the stool at other positions in such a manner that the chair not only can fully function as a reclining chair, but also has a collapsible structure in which the chair body can be freely rotated, with a provision to prevent the chair body from being unexpectedly disengaged from the stool when it is used as a reclining chair.

Another object of the present invention is to provide such a collapsible reclining chair in which its stool and chair body can be disposed not only in a straightened position to each other but also in a twofold position in which one is put on the other.

A further object of the present invention is to provide such a collapsible reclining chair having elbowrests, in which a guide hole is formed in the elbowrests and the stool is interlinked to the guide holes.

Yet another object of the present invention is to provide such a collapsible reclining chair in which a stopper mechanism for adjusting the position of the backrest of the chair body to a desired angle of inclination is uniquely devised so that the manual operation thereof is simplified and the possibility of fingers being nipped by the parts of the chair or other accidents is eliminated.

BRIEF DESCRIPTION OF THE DRAWINGS

Hereinafter, the present invention will be described in detail by way of the preferred embodiments thereof with reference to the accompanying drawings, in which:

FIGS. 6A, 6B and 6C are side views showing the folding sequence of the collapsible reclining chair according to the present invention, respectively; and FIGS. 7A and 7B through FIGS. 10A and 10B are schematic side views of several modifications of the collapsible reclining chair according to the present invention showing the states thereof in use and the folded states thereof, respectively.

DETAILED DESCRIPTION

Figure 1:
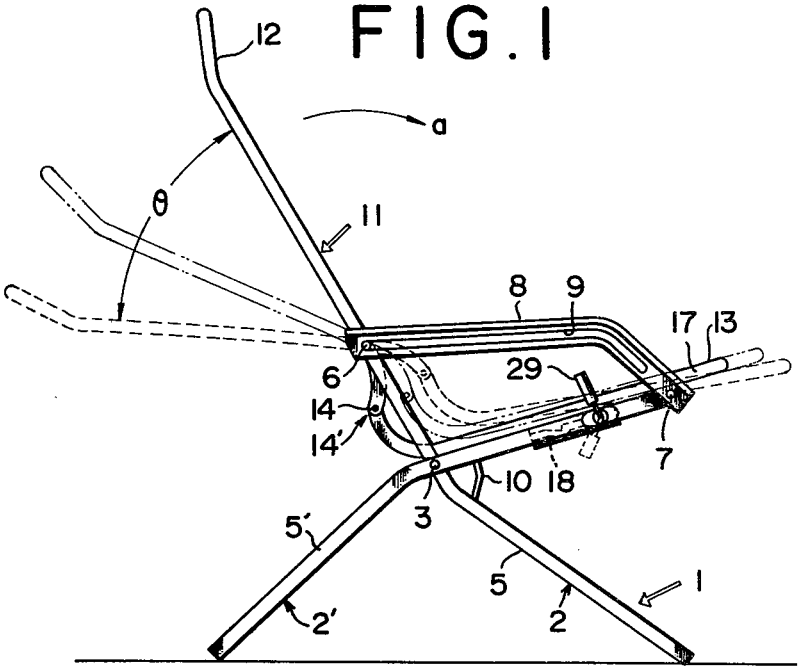
FIG. 1 is a side view of a preferred embodiment of the collapsible reclining chair according to the present invention, showing a state thereof in use.
Figure 2:
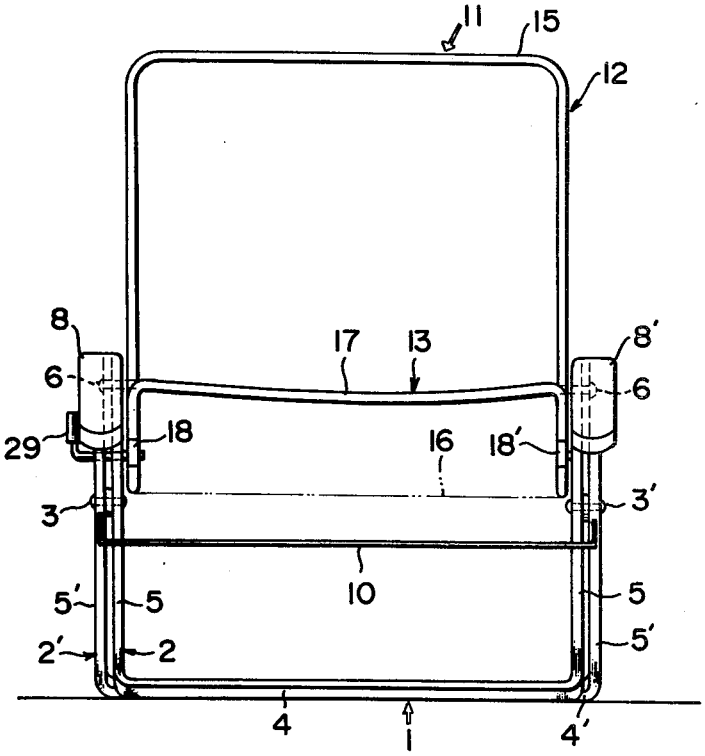
FIG. 2 is a front elevation of the collapsible reclining chair shown in FIG. 1.

Referring now to the drawings, especially to FIGS. 1 and 2 showing the preferred embodiment of the reclining chair according to the present invention, the reference numeral 1 indicates a stool comprising two frame members 2 and 2' each being bent substantially into a U-shape as viewed in the front elevation so as to have a horizontal bar section 4 and 4' and two side bar sections 5,5 and 5',5', said frame members 2 and 2' intersecting each other almost at the centers of said side bar sections 5 and 5' so as to substantially form an X-shape as seen in the side view and being pivotally mounted to each other by means of pivoting pins 3 and 3' at said intersections so as to form said stool 1 which is freely foldable and extendable.

The side bar sections 5 and 5' of said frame members 2 and 2' are bent at a certain obtuse angle, and, at a position suitably above the bent portions of said frame members 2 and 2', to be disposed and mounted at an ordinary angle thereto is a chair body comprising a back-rest and seat portion to be described later.

Also, the stool 1 is provided with elbowrests 8 and 8' which are pivotally mounted by means of pivoting pins 6,6' and 7,7' to the upper ends of the side bar sections 5 and 5', respectively.

As exemplarily shown in the drawings, the elbowrests 8 and 8' are bent downwardly at a certain obtuse angle and a guide hole 9 is formed therein longitudinally thereof, respectively. Said pivoting pin 6 mounted onto the upper end of the side bar section 5 which is to be disposed on the rear side when the stool 1 is extended is slidably fitted into the guide hole 9 so as to pivotally support the elbowrest 8. While, the other end of the elbowrest 8 is pivotally mounted independently of the guide hole 9 by means of the pivoting pin 7 onto the upper end of the side bar section 5' which is to be disposed on the front side when the stool 1 is extended. On the underside of the side bar sections 5', 5' of the frame member 2', provided is a supporting bar 10 having the opposite end portions thereof substantially rectangularly bent upward to be coupled to the underside of said side bar sections 5' at positions a suitable distance above said pivoting pins 3. When the stool 1 is extended as shown in FIG. 1, the supporting bar 10 abuts against suitable projections on the side bar sections 5 of the frame member 2 so that the stool 1 can be held in a stable state for use in which the frame members 2 and 2' are longitudinally extended around the pivoting pins 3 and 3'.

11 is a chair body composed of a back-rest 12 and seat portion 13 which are coupled to each other by means of pivoting pins 14 so as to freely foldable and extendable around the pivoting pins 14.

The back-rest 12 of the chair body 11 comprises a pipe member 15 bent into an inverted U-shape as seen in the front elevation and a sheet 16 of cloth, vinyl or the like material which is stretched over the pipe member 15. Likewise, the seat portion 13 comprises a pipe member 17 of almost U-shape in plan and a sheet 16 of the like material stretched thereover.

Figure 3:
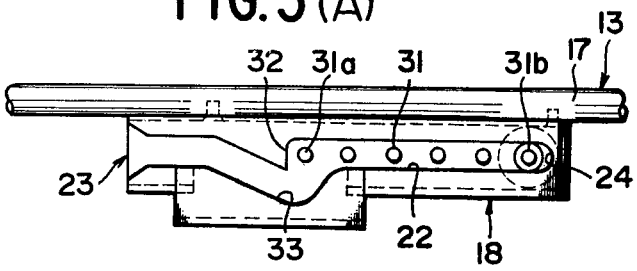
FIGS. 3A, 3B and 3C are side views of preferred embodiments of the roller holder used in the collapsible reclining chair according to the present invention, respectively.
Figure 3:
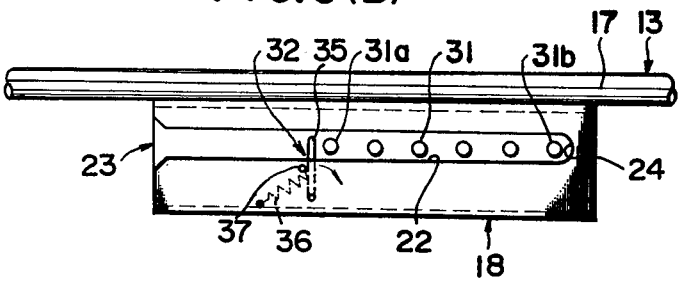
Figure 3:
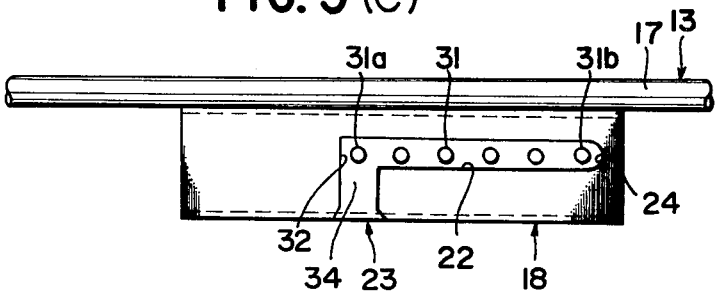
Figure 4:
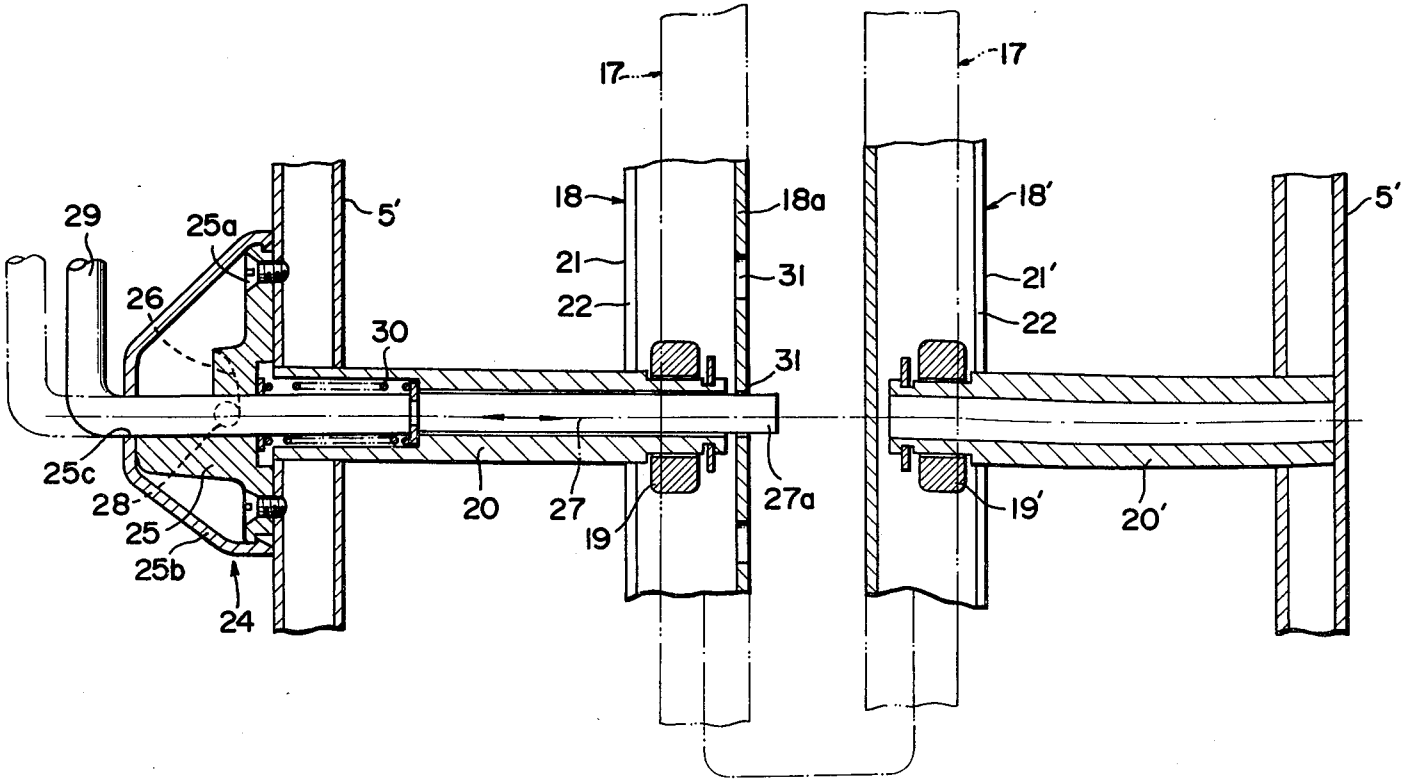
FIG. 4 is an enlarged section of a preferred embodiment of a stopper mechanism of the collapsible reclining chair according to the present invention.

The chair body 11 is supported on the stool 1 so that the back-rest 12 is freely inclinable and the seat portion 13 is freely movable in the longitudinal direction. In this case, the back-rest 12 may be pivotally mounted onto the side bar sections 5 of the frame member 2 at the rear end of the stool 1. In the illustrated embodiment, this purpose of pivotal mounting is attained also by means of the pivoting pins 6 passed through the guide holes 9 of the elbowrests 8 and 8', and the back-rest 12 is pivotally mounted onto the elbowrests 8 and 8' at a position a predetermined distance above the pivoting positions 14 and 14' of the back-rest 12 and seat portion 13 so as to be freely inclinable around the pivoting pins 6. To support the seat portion 13, mounted onto the underside of the opposite sides of the pipe member 17 constituting the skeleton of the seat portion 13 are roller holder 18 and 18' having a rectangular shape in section, respectively, as shown in FIGS. 3 and 4 in greater detail. Correspondingly thereto, provided projectedly inwardly from the side bar sections 5' of the other frame member 2' are cylindrical roller shafts 20 and 20' onto which rollers 19 and 19' are mounted freely rotatably, respectively, so that the rollers 19 and 19' can be fitted into the roller holders 18 and 18', respectively, while permitting a free movement of the seat portion 13 in the longitudinal direction.

The roller shafts 20 and 20' moves relatively to the roller holders 18 and 18' as the seat portion 13 moves in the longitudinal direction. Therefore, cutouts 22 and 22' are provided in the outer side walls 21 and 21' of the roller holders 18 and 18', respectively, to permit such a relative movement.

Also, according to the present invention, as ilustrated by the respective modifications of the roller holder shown in FIGS. 3A, 3B and 3C, the rear ends of the roller holders 18 and 18', namely the rear ends of said cutouts 22 and 22' are formed as open ends 23, while the front ends thereof are formed as closed ends, so that the rollers 19 and 19' can be fitted into or disengaged from the roller holders 18 and 18' through the open ends 19 and 19', respectively. That is to say, the roller holders 18 and 18' have a suitable length which is predetermined so that when the back-rest 12 is kept at an inclined position within the range of the angle of inclination indicated by $\theta$ in FIG. 1, the rollers 19 and 19' are kept engaged with the roller holders 18 and 18' and permitted to move relatively to the latter, while the rollers 19 and 19' are disengaged from the roller holders 18 and 18' when the back-rest is inclined forwardly from the position indicated by the solid line in FIG. 1 in the direction shown by an arrow a to be folded into the states shown in FIGS. 6B and 6C.

Further, according to the present invention, a stopper mechanism 24 is provided for permitting the adjustment and locking of the back-rest 12 to a desired angle of inclination.

The stopper mechanism 24 has a construction to be described hereinbelow.

As shown in FIG. 4 in greater detail, a cylindrical cam 25 having a cam face 26 is attached by means of screws **25*a* or the like onto the outside of one of the side bar sections 5' coaxially with the roller shaft 20, and a locking pin 27 is passed through the cam 25 and the roller shaft 20 so that the one end 27*a* thereof is inserted into the roller holder 18. The other end portion of the locking pin 27 is extended outside of the cam 25 and bent rectangularly to form a lever 29, and a cam follower 28 cooperating with the cam face 26 is projected from the locking pin 27** at right angle to the axis of the latter.

A coil spring 30 is wound around the locking pin 27 inside the roller shaft 20 so as to urge the locking pin 30 towards the roller holder 18.

In the meantime, a plurality of pin holes 31 are successively provided in the inner wall **18*a* of the roller holder 18 facing the inner end 27*a* of the locking pin 27 in such a manner that the inner end 27*a* of the locking pin 27 can be inserted into a desired one of these pin holes 31**.

Further, according to the present invention, a cover **25*b* having at the crown thereof a pin hole 25*c* for the insertion of the locking pin 27 and held onto the cam 25 is placed over the cam 25 and the cam follower 28 engaging with the cam face 26** thereof.

To hold the cover **25*b*, a pair of engaging portions are provided along the outer periphery of the base portion of the cam 25 and the inner periphery of the bottom opening of the cover 25*b*** so that these engaging portions are engaged with each other.

Figure 5:
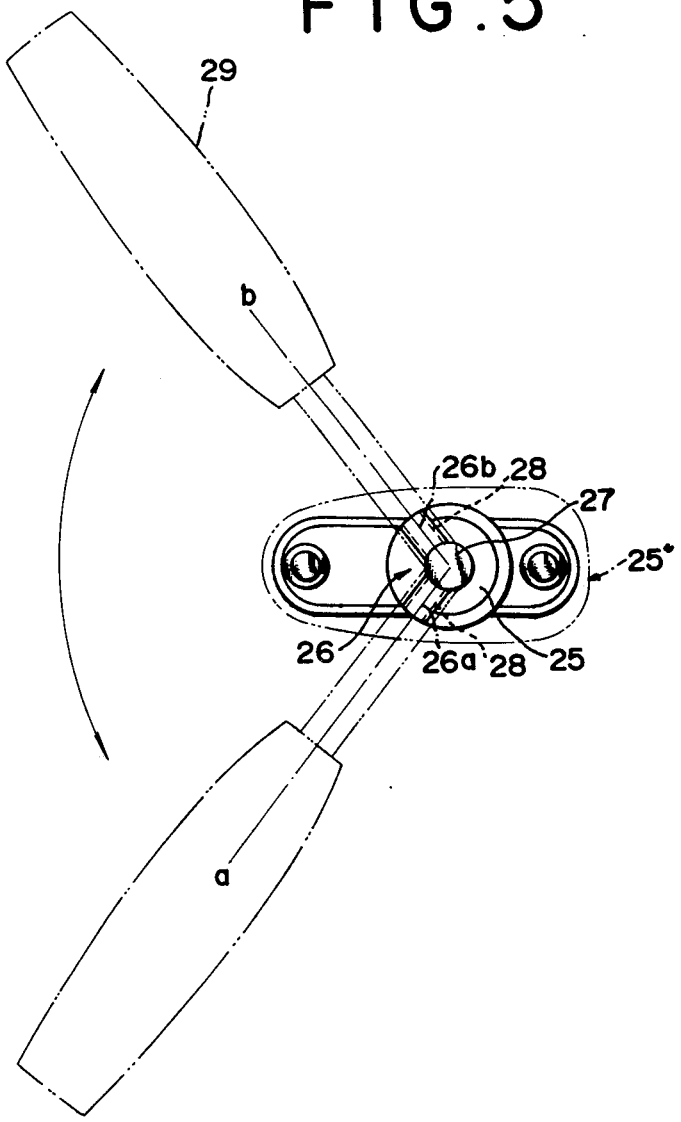
FIG. 5 is a schematic external view of the stopper mechanism shown in FIG. 4.
Figure 7A:
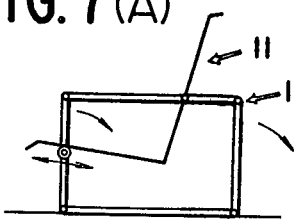
Figure 7B:
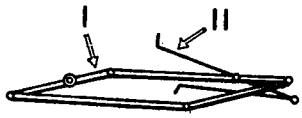
Figure 8A:
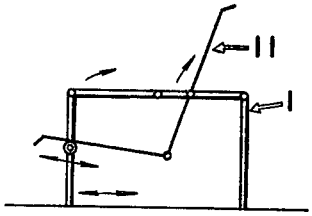
Figure 8B:
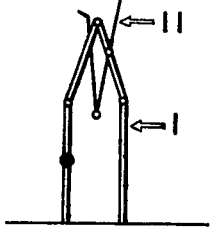
Figure 9A:
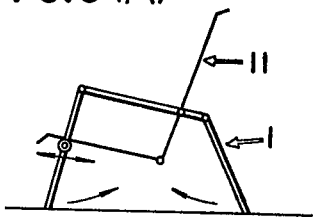
Figure 9B:
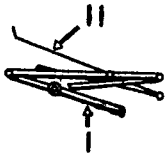
Figure 10A:
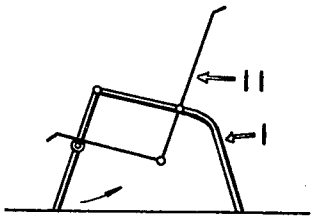
Figure 10B:
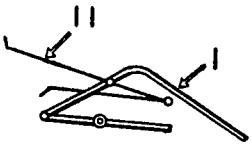

As shown in FIG. 5, the cam face 26 is circumferentially inclined upwardly from the bottom **26*a* of one side of the cam 25 towards the higher portion 26*b* at the other side of the cam 25 so as to permit the end portion 27*a* of the locking pin 27 to be inserted into and disengaged from the pin holes 31 through an axial movement of the locking pin 27**.

In the stopper mechanism having a construction as described herein above, the lever 29 is placed at a position a shown in FIG. 1, the cam follower 28 abuts against the lower portion **26*a* of the cam face 26 and, thus, the locking pin 27 is placed at a position indicated by the solid line in FIG. 5, in which the inner end 27*a* of the locking pin 27 is inserted in the pin hole 31 to be locked therein and to lock the back-rest 12 at a certain inclined position. Then, if the lever 29 is turned upward to a position b shown in FIG. 5, the cam follower 28 is moved from the lower portion 26*a* to the higher portion 26*b* of the cam face 26. Therefore, the locking pin 27 is shifted towards the outside by the action of the coil spring 30 and the inner end 27*a* thereof is disengaged from the pin hole 31** to release the locked state.

In the thus released condition, the seat portion 13 are freely movalbe in the longitudinal direction and the back-rest 12 can be adjusted to a desired angle of inclination. After the adjustment of the back-rest 12, turning the lever 29 from the position b to a shown in FIG. 5 will cause the inner end **27*a* of the locking pin 27 to be inserted again into a desired pin hole 31** to secure the locked condition.

In the stopper mechanism 24 of the locking pin type as described herein above, since the cover **25*b* is placed over the cam 25 and the cam follower 28 cooperating therewith which is provided on the locking pin 27 extended through the cam 25 to the outside of the cover 25*b*, the possibility of injuring the finger tips by the engaging portions of the cam face 26 can be eliminated, even if the cam 25 is attached onto the outside face of the illustrated embodiment, for facilitating the adjustment operation of the back-rest 12 by the person seating on the seat portion 13. Also, since a deposition of dusts onto such engaging portions of the cam face 26 can be prevented, the effect of the stopper mechanism according to the present invention is remarkable, especially, where the engaging portions of the cam face 26** is lubricated with oil to ensure a smooth movement. Besides, the hands or clothes will not be stained with the lubricating oil.

Further, since the cam follower 28 is provided on the locking pin 27 for engagement with the cam face 26, the interval between the outer side of the side bar section 5' of the stool 5 can be made wider, as compared with such a construction in which the locking pin 27 is merely bent and the bottom portion of the lever 29 is adapted to be directly engaged with the cam face 26. Thus, not only the operation of the lever 29 is facilitated, but also the possibility of the hands being abraded by the side bar section 5' or the finger tips being nipped between the lever 29 and the side bar section 5' to be injured when operating the lever 29 can be completely eliminated.

Further, as shown in FIGS. 3A, 3B and 3C, the roller holder 18 is provided with a stopper 32 in the vicinity of the rearmost pin hole 31*a* so as to prevent the rollers 19 and 19' from being spontaneously disengaged from the roller holders 18 and 18', while permitting the relative movement of the roller holders 18 and 18' to the rollers 19 and 19', respectively, in the range defined by the foremost pin hole 31*b* and the rearmost pin hole 31*a*.

The stopper 32 may be constituted by forming the cutout 22 so that it has a downwardly curved portion 33 and by projecting downwardly a portion of the upper part of the outer side wall of the roller holder 18 into said downwardly curved portion 33, as shown in FIG. 3A. Alternatively, the stopper 32 may be constituted by forming the cutout 22 so that it is bent rectangularly at a portion 34 thereof in the vicinity of the rearmost pin hole 31*a* and the roller shaft 20 can abut against the rear edge of the thus bent portions 34 of the cutout 22, as shown in FIG. 3C, or the stopper 32 may comprise a stopper pin 35 having the lower end thereof pivotally mounted to the roller holder 18 so as to be swingable in the longitudinal direction and having the other end thereof projected into the cutout 22 which is formed straightforwardly in the longitudinal direction of the roller holder 18, as shown in FIG. 3B. In the modification of the stopper 32 cited last, the stopper pin 35 is urged rearwardly by a spring 36 so as to abut against an abutting pin 37 to be held at erected position thereat, and the roller 19 can be inserted into the roller holder 18 by pushing down the stopper pin 35 forwardly against the elasticity of the spring 36.

Thus, when the back-rest 12 is turned forwardly around the pivoting pin 6 in the direction indicated by the arrow a in FIG. 1 after the locking pin 27 being disengaged from the pin hole 31 as mentioned previously, the seat portion 13 moves rearwardly until the roller shalft 20 abuts against the front end, namely, the closed end 24 of the cutout 22 of the roller holder 18 and the relative movement of the roller shaft 20 to the roller holder 18 is temporarily stopped thereupon. In this state, the stool 1 takes an intermediately folded position as shown in FIG. 6A, and the chair body 11 has its back-rest 12 folded on the seat portion 13 and is held in an almost horizontal position.

This state may be called a semi-folded position, and the reclining chair may be stored in this state with the stool 1 being erected at a certain place in the living space, when it is not used. If the chair body 11 is further turned around the pivoting pin 6 from the state shown in FIG. 6A in the direction of the arrow b, the chair body 11 is raised upward with the pivoting pin 6 being guided by the guide hole 9 of the elbowrest 8. In this case, suitably manipulating the roller shaft 20 and 20' so that these are guided towards the open end 23 of the roller holder 18 and 18' without being obstructed by the stopper 32 of the roller holders 18 and 18' permits the rollers 19 and 19' to be disengaged from the roller holders 18 and 18' through the rotation of the chair body 11. Thus, the chair body 11 takes an erected position as shown in FIG. 6B. In this case, the stool 1 is further folded to reduce the space occupied thereby, and the elbowrests 8 and 8' also have the rear ends thereof turned downwards around the pivoting pins 7 at the front ends thereof. In this connection, the position where the chair body 11 is pivotally mounted by the pivoting pins 6 onto the stool 1 is predetermined so that the chair body 11 abuts against the rollers 19 and 19' or roller shafts 20 and 20' so as to be held almost in line with the stool 1 when the chair body is in its erected position as shown in FIG. 6B.

If the chair body 11 is turned further from the state shown in FIG. 6B in the direction of the arrow c, the pivoting pin 6 moves forwardly along the guide hole 9 of the elbowrest 8 and the rear end of the elbowrest 8 approaches the stool 1 to be finally placed over the latter, and the chair body 11 is placed between the side bar sections 5,5' and 5,5' of the folded stool 1 almost flush therewith so as to occupy a minimum space.

In this state, the chair body 11 abuts against the supporting bar 10 to be held in the thus folded position as shown in FIG. 6C. Thus, the chair can be easily carried by taking the elbowrests 8 and 8' or other parts or held on the floor in said folded position. Therefore, in the completely folded position as shown in FIG. 6C, the chair can be not only conveniently stored in a narrower place such as closets but also readily packed.

While, to extend the thus folded chair for use, the chair body 11 is turned sequentially to the direction opposite to the directions of the arrows c, b and a. In this case, when the chair body is turned in the direction opposite to the arrow b after passing the state shown in FIG. 6B, the rollers 19 and 19' are fitted into the roller holders 18 and 18', respectively, and then turned in the direction opposite to the arrow a until the state shown in FIG. 1 is reached.

Although several modifications to the particular embodiment as described hereinbefore may be devised as shown in FIGS. 7A and 7B through 10A and 10B, it goes without saying that these modifications fall in the scope of the present invention, in that each of the stool 1 of these modifications has a basic arrangement substantially identical to that of the present invention with the same effects as those achieved by the present invention.

The elbowrests 8 and 8' provided in the particular preferred embodiment described hereinbefore may be omitted if unnecessary. In such a case, the pivoting pins 6 are used only for pivotally mounting the side bar sections 5 onto the back-rest 12 of the chair body 11. Alternatively, the elbowrests 8 and 8' may be formed of a freely deformable material such as leather belts in such a manner that the elbowrests 8 and 8' are stretched under tension in use of the chair and relaxed in the folded state thereof.

What is claimed is:

1. A collapsible reclining chair comprising in combination:

(a) a chair body (11) having a back-rest (12) and a seat portion (13) which are pivotally coupled to each other so as to be freely foldable and extendable;

(b) a stool composed of frame members (2, 2') having side sections (5, 5') said frame members (2, 2') being pivotally coupled to each other at suitable positions of the side bar sections (5, 5') so as to be freely foldable and extendable, said back-rest (12) of said chair body (11) being rotatably pivoted onto the rear end of said stool (1) in such a manner that said back-rest (12) is freely inclinable and said seat portion (13) is freely movable in the longitudinal direction; and, (c) roller holders (18, 18') each mounted onto the opposite sides of said seat portion (13) and having the rear ends thereof opened, and rollers (19, 19') fitted onto a roller shaft (20, 20') with a stopper mechanism (24), said roller shaft (20, 20') being mounted onto each side of said side bar sections (5, 5') of one of said frame members, said rollers (19, 19') being removably fitted into said roller holders (18, 18') through the open ends thereof in such a manner that the rollers can be adjusted by means of said stopper mechanism (24) to a desired position in said roller holders (18, 18') and said chair body is freely rotatable after said rollers (19, 19') are disengaged from said roller holders (18, 18') said stopper mechanism comprising a locking pin which is passed through one of said roller shafts to be inserted into the roller holder corresponding thereto so that said locking pin is removably engageable with one of a plurality of pin holes successively formed longitudinally in the inner side wall of said corressponding roller holder, a cylindrical cam having a cam face on the outer side thereof and mounted onto the outside of one of said side bar sections coaxially with said one of the roller shafts, said locking pin passing through said cam and being provided with a cam follower at the outer part thereof extending outside said cam, the further outer part of said locking pin being bent so as to form a lever for a handle, and a cover placed over said cam and cam follower.

* * * * *